US006613272B2

(12) United States Patent
Divjak et al.

(10) Patent No.: US 6,613,272 B2
(45) Date of Patent: Sep. 2, 2003

(54) VESSEL FOR METALLURGICAL PURPOSES

(75) Inventors: Franz-Josef Divjak, Rheinberg (DE); Hans-Werner Gohres, Duisburg (DE); Olaf Kleinjan, Moers (DE); Sait Taniyan, Moers (DE); Günter Schwalenstöcker, Essen (DE); Norbert Asmus, Moers (DE)

(73) Assignees: Mannesmannröhren-Werke AG, Münlheim (DE); Asku-Scholten GmbH, Duisburg (DE); Thyssen Krupp Stahl AG, Duisburg (DE)

( * ) Notice: Subject to any disclaimer, the term of this patent is extended or adjusted under 35 U.S.C. 154(b) by 0 days.

(21) Appl. No.: 09/928,908

(22) Filed: Aug. 13, 2001

(65) Prior Publication Data

US 2002/0066983 A1 Jun. 6, 2002

Related U.S. Application Data

(63) Continuation of application No. PCT/DE00/00443, filed on Feb. 11, 2000.

(30) Foreign Application Priority Data

Feb. 11, 1999 (DE) ..... 199 07 482
Feb. 10, 2000 (DE) ..... 100 06 771

(51) Int. Cl.[7] ..... C21C 5/50; B22D 41/04
(52) U.S. Cl. ..... 266/246; 266/275
(58) Field of Search ..... 266/246, 275

(56) References Cited

U.S. PATENT DOCUMENTS 6,110,414 A * 8/2000 Gohres et al. ..... 266/246

FOREIGN PATENT DOCUMENTS

| | | |
|---|---|---|
| DE | 1 166 980 | 4/1964 |
| DE | 1 172 404 | 1/1965 |
| DE | 15 08 156 A | 10/1969 |
| DE | 1 583 308 | 6/1970 |
| DE | 29 01 011 | 12/1979 |
| DE | 195 38 530 C | 12/1996 |
| DE | 197 06 056 C | 5/1998 |
| WO | WO 95 25819 A | 9/1995 |

* cited by examiner

*Primary Examiner*—Melvyn Andrews
(74) *Attorney, Agent, or Firm*—Henry M. Feiereisen

(57) ABSTRACT

The invention relates to a vessel for metallurgical purposes intended for transporting molten metals. The tank has a metal jacket provided with a heat-proof lining. Two lifting lugs are disposed on the outer side opposite one another, each of which is supported by a lug shield connected to the metal jacket. The lug shield is disposed so as to limit movement in vertical and peripheral direction. Alternatively, the vessel can be made of sections of pipe, with the lug shield connected to a reinforcement ring on the pipe sections. Means are fixed on the metal jacket and/or the reinforcement ring(s) for receiving the own weight of the lug shield and the vessel when the vessel is in a vertical or tilted position.

27 Claims, 9 Drawing Sheets

(A-A)

(B-B)

(A-A)

(B-B)

(A-A)

(B-B)

(B-B)

(A-A)

(C-C)

(X)

Fig.5A
(A-A)
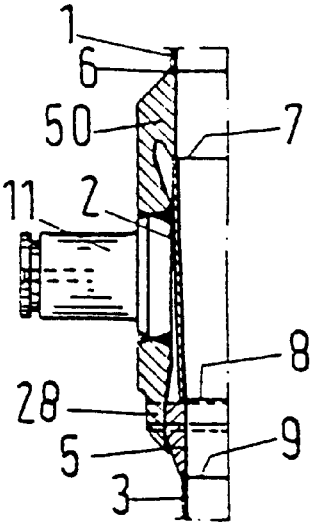
Fig.5B
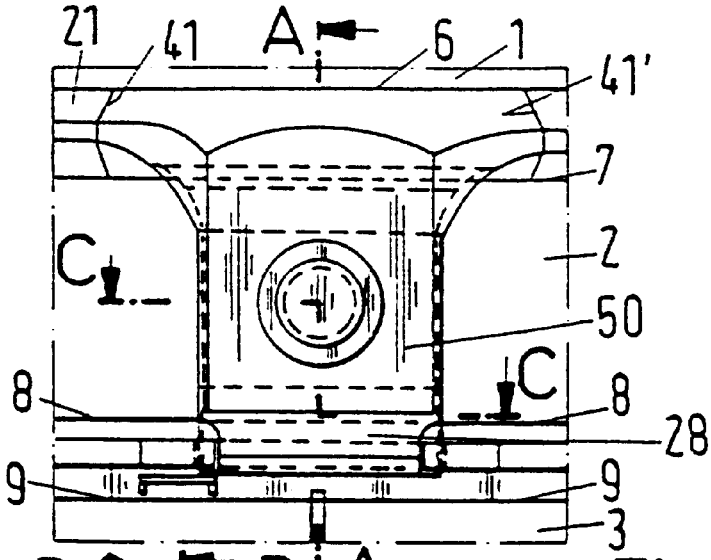
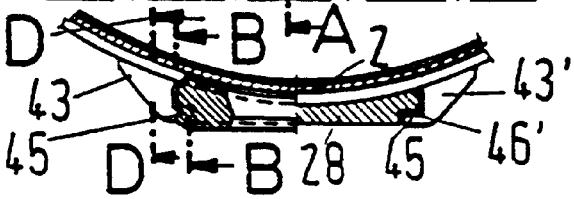
Fig.5C
(C-C)
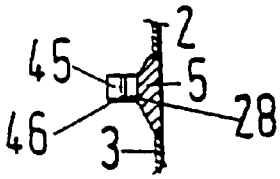
Fig.5D
(B-B)
Fig.5E
(D-D)
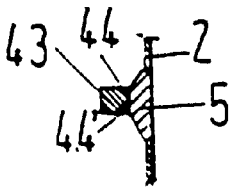

(A-A)

(B-B)

(A-A)

(B-B)

(A-A)

(A-A)

(B-B)

VESSEL FOR METALLURGICAL PURPOSES

CROSS-REFERENCES TO RELATED APPLICATIONS

This application is a continuation of prior filed copending PCT International application no. PCT/DE00/00443, filed Feb. 11, 2000.

This application claims the priorities of German Patent Application Serial No. 199 07 482.8, filed Feb. 11, 1999, and German Patent Application Serial No. 100 06 771.9, filed Feb. 10, 2000, the subject matter of which is incorporated herein by reference.

FIELD OF THE INVENTION

The invention relates to a vessel for metallurgical purposes for the transport of molten metals, and more particularly to a vessel that has a metal jacket with a heat-proof lining and opposing lifting lugs on the outside of the vessel, wherein the lifting lugs are supported by a lug shield connected to the metal jacket. The metal jacket can also have two axially spaced reinforcement rings, with the lifting lugs being supported by a lug shield which is connected with the reinforcement rings and forms a small radial gap to the metal jacket.

BACKGROUND OF THE INVENTION

Vessels for metallurgical purposes are well known (see, for example, DE-AS 11 66 980, DE-PS 11 72 404, DE-AS 29 01 011). All designs have in common that the vessel has a metal jacket provided with heat-proof lining. Two opposing lifting lugs are disposed on the outside of the metal jacket, which are supported on a reinforcement strip, a lug shield or a box construction, all of which are in turn fixedly connected with the metal jacket. Typically, the metal jacket is reinforced with two circumferential reinforcement rings which are spaced apart in the axial direction, with the lug shield secured between the reinforcement rings. The known constructions are not optimized for stress and have a particularly unfavorable ratio of tare weight to filling weight.

An improved vessel for metallurgical purposes is known from DE 197 06 056 C1. It consists of a metal jacket provided with a heat-proof lining, is made of tubular sections of pipe and has two peripheral spaced-apart reinforcement rings which are integrated in the metal jacket. Two opposing lifting lugs are disposed on the outside of the metal jacket and supported by a respective lug shield which is connected with the reinforcement ring by a weld seam. The lug shield is disposed between the two reinforcement rings so as to have a small radial separation from the metal jacket.

Disadvantageously, the fixed connection between the lug shield and the reinforcement rings employed in this design generates high stress values as well as stress peaks in the connecting region which can reduce the total load capacity. Occasionally, additional stress reserves may not be available, thereby creating the risk of plastic flow.

It would therefore be desirable to provide a vessel for metallurgical purposes with a capacity between 80 tons and 400 tons, in particular a vessel with a circular cross-section, which has an improved stress distribution for the total load capacity in the region of the attachment of the lug shield, and which has increased stress reserves for preventing plastic deformation. Moreover, it would also be desirable to improve the ratio between tare weight and filling weight.

SUMMARY OF THE INVENTION

According to one aspect of the invention, the vessel has a metal jacket with a heat-proof lining and two opposing lifting lugs disposed on the outside of the vessel, wherein each of the lifting lugs is supported by a lug shield connected to the metal jacket. The lug shields allows limited movement in the vertical and peripheral direction. The metal jacket includes means for supporting the own weight of the lug shield and the vessel when the vessel is in a vertical or tilted position.

According to another aspect of the invention, the metal jacket can be made of sections of pipe and include two axially spaced-apart reinforcement rings integrated in the metal jacket. In this embodiment, the lug shield connected with the reinforcement rings instead of directly to the vessel.

With this arrangement, the relatively cold lug shield does not hinder the thermal expansion of the vessel, while forces can still be transmitted via these means. For example, the means can be formed as a box construction encircling the lug shield and allowing limited movement of the lug shield. It is immaterial if the box construction is rectangular, round or oval. When the vessel is in its rest position, the lug shield, due to its own weight, contacts the region of the box construction in the 6 o'clock position. When the vessel is lifted, the lug shield contacts the region of the box construction in the 12 o'clock position. For example, if the vessel is tilted by 90°, then the lug shield contacts the region of the box construction in the 3 o'clock or 9 o'clock position. Alternatively, the box construction can be replaced by clamp-like elements which frame the marginal regions of the lug shield. A free lug shield is optimal for stress management, because the vessel can unimpededly and freely expand in the vertical and circumferential direction when heating up. A different more advantageous arrangement of the lug shield may be selected depending on the size and the cross-section of the vessel. The forces to be transmitted have to be taken into account. In such design, only a marginal region of the lug shield facing the respective reinforcement ring is materially connected with the reinforcement ring. This design has the advantage that the material connection can transmit large forces, while allowing unrestricted expansion in the vertical direction, because the opposing marginal region can move freely. Depending on the design, the material connection can be strong enough so that means for supporting the tare weight, in particular in a tilted position of the vessel, can be eliminated. In other situations, a guide for guiding the freely moveable marginal region can be provided.

The means can be ribs which are guided in slots or guide tangs, with the marginal region of the lug shield guided in their respective gap, or clamps which guide the lateral regions of the freely moveable marginal region of the lug shield. The means can be integral parts of the reinforcement ring or can be connected with the reinforcement ring through a weld seam.

The material connection between the lug shield and the reinforcement ring is preferably provided on the upper reinforcement ring. To make the seam as short as possible, it is proposed to form this marginal region as a segment of the reinforcement ring, with the segment being materially connected to the abutting segments of the reinforcement ring by a transverse seam. The total length of the transverse seam is shorter than the peripheral longitudinal seam.

To simplify the construction further, the lower reinforcement ring can be omitted. In this modification, too, the marginal region of the lug shield can be guided or entirely omitted. The guide means are formed in a similar manner as in the aforedescribed construction of the vessel. A particular feature is a circumferential ring which is materially connected with the marginal region of the two lug shields. To provide sufficient guidance between the ring and the metal jacket, circumferentially distributed spacers are arranged on the lug shield and/or on the ring.

Further features and advantages of the present invention will be apparent from the following description of preferred embodiments and from the claims.

BRIEF DESCRIPTION OF THE DRAWING

The following Figures depict certain illustrative embodiments of the invention in which like reference numerals refer to like elements. These depicted embodiments are to be understood as illustrative of the invention and not as limiting in any way.

FIG. 5A is a cross-section along the line A—A in FIG. 5B;

FIG. 5B depicts a fifth embodiment, otherwise identical to FIG. 1B;

FIG. 5C is a cross-section along the line C—C in FIG. 5C;

FIG. 5D is a cross-section along the line B—B in FIG. 5C;

FIG. 5E is a cross-section along the line D—D in FIG. 5C;

DETAILED DESCRIPTION OF PREFFERED EMBODIMENTS

Figure 1A:
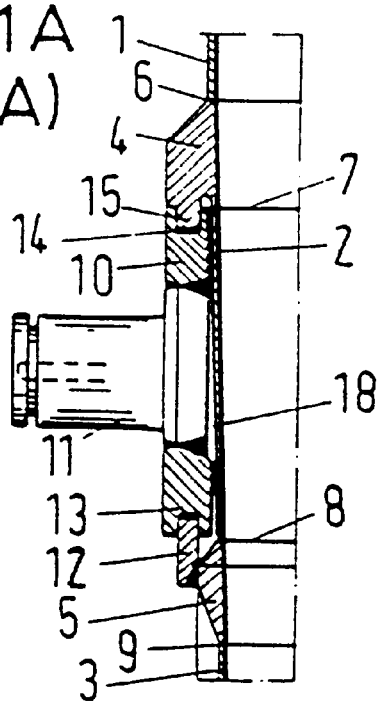
FIG. 1A is a cross-section along the line A—A of FIG. 1B.
Figure 1B:
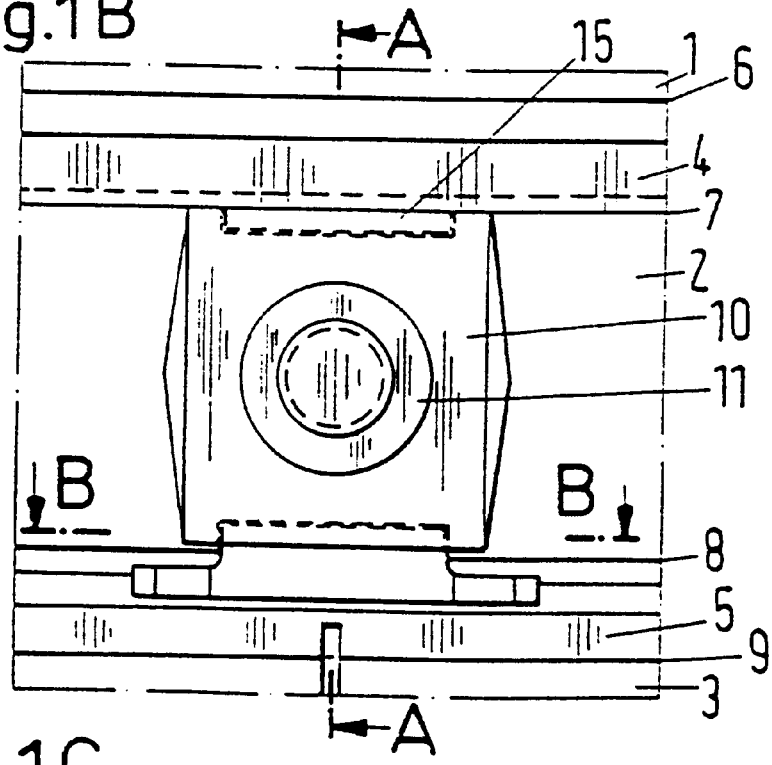
FIG. 1B is a partial front view of a metallurgical vessel according to the invention in the region of the lug shield.
Figure 1C:
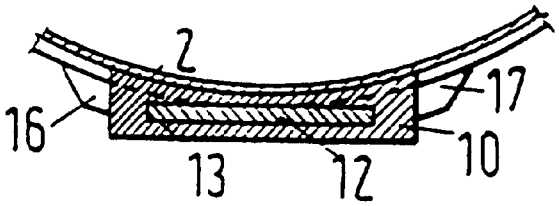
FIG. 1C is a cross-section along the line B—B in FIG. 1B.

FIGS. 1A–1C is a plan view and a cross-sectional view of a first embodiment of a metallurgical vessel according to the invention. In this embodiment, the metal jacket provided with the fire-proof lining includes three sections of pipe 1,2,3, with an upper reinforcement ring 4 and a lower reinforcement ring 5 disposed as an integral part between the sections of pipe. Indicated by thin lines is the material connection between the two reinforcement rings 4, 5 through peripheral weld seams 6–9. The lug shield 10 is disposed between the two reinforcement rings 4, 5 and can move freely in both the vertical and circumferential direction. The own weight of the lug shield 10 including the welded lug 11 is absorbed in the vertical position of the vessel by a rib 12 disposed on the lower reinforcement ring 5. This rib 12 engages with a recess 13 disposed in the lower marginal region of the lug shield 10, so that the lug shield 10 and the vessel can be supported by the respective narrow side of the rib 12, even when the vessel is tilted. A similar recess 14 is disposed in the upper marginal region of the lug shield 10. A rib-like extension 15 of the upper reinforcement ring 4 engages with this recess 14. In this embodiment, the extension 15 is an integral part of the reinforcement ring 4. However, the extension 15 could also be attached as a separate element to the reinforcement ring, as illustrated in the lower region.

To provide the lower rib 12 with sufficient stiffness, the right and left side of the rib is provided with arm-like extensions 16, 17.

For assembly, the metal jacket 1–3 with the two welded reinforcement rings 4,5 is fabricated first, whereafter the respective lug shield 10 including the welded lug 11 is pushed from below onto the rib-shaped extension 15 of the upper reinforcement ring 4 and adjusted in this position. Subsequently, the lower rib 12 is inserted from below into the recess 13 and materially connected with the lower reinforcement ring 5.

This embodiment has the advantage that the lug shield 10 is moveable in the vertical and circumferential direction, without hindering the thermal expansion of the vessel. The guide aids in supporting the own weight of the lug shield 10 including the lug 11 and of the vessel when the vessel is in a vertical and tilted position. It should also be mentioned that the lug shield 10 is spaced apart from the metal jacket tube 2 by a gap 18. This arrangement prevents the metal jacket tube 2, which is at a higher temperature, from directly contacting the cold lug shield 10. According to thermodynamic theory, heat flow by radiation is proportional to the fourth power of the temperature difference, whereas heat flow by conduction is directly proportional to the temperature difference.

Figure 2A:
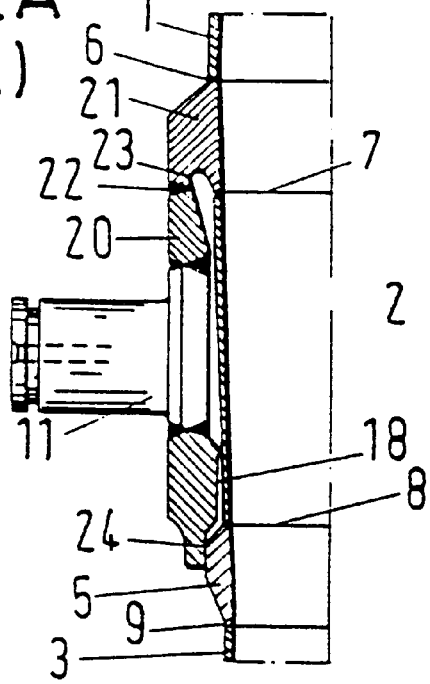
FIGS. 2A–2C depicts a second embodiment, otherwise identical to FIGS. 1A–C.
Figure 2B:
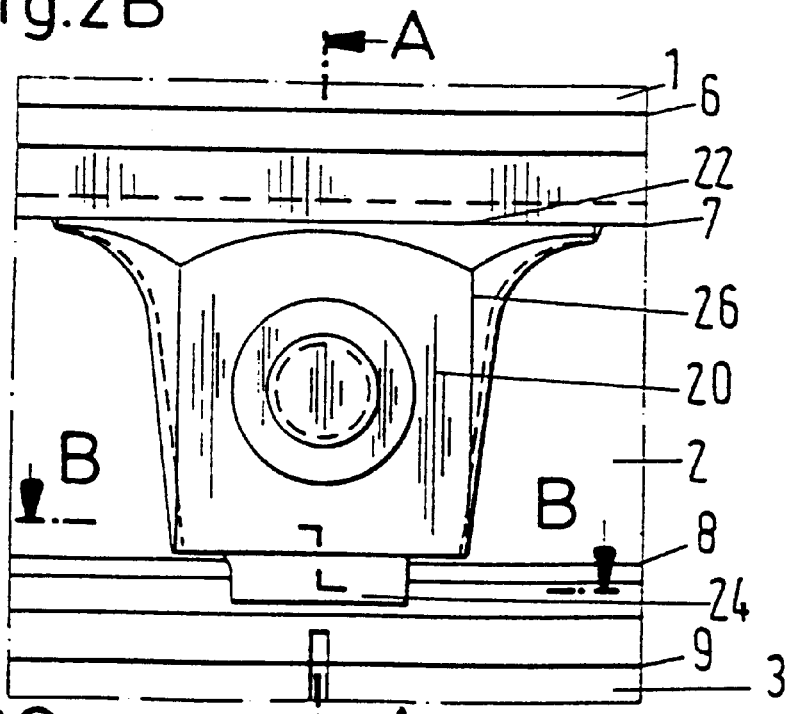
Figure 2C:
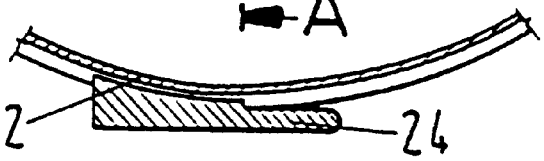

FIGS. 2A–2C depict a second embodiment, wherein identical parts are given identical reference numerals. Unlike FIGS. 1A–1C, the lug shield 20 is materially connected with the upper reinforcement ring 21 by a partial peripheral seam 22. The upper reinforcement ring 21 has a conventional downwardly extending nose-shaped extension 23. The lower marginal region of the lug shield 20 which is formed as a rib 24, can move freely and slidingly contacts the surface of the lower reinforcement ring 5. Depending on the manner in which the upper marginal region of the lug shield 20 is attached, a guide for the lug shield 20 can be eliminated, as illustrated. This means that the forces which try to bend the lug shield 20 away from the vessel, as well as the own weight of the lug shield and of the vessel have to be absorbed by the upper weld seam 22 when the vessel is in a tilted position.

Unlike the embodiment of FIGS. 1A–1C this embodiment can advantageously eliminate the complex fabrication steps for the two recesses, while large ladle weights can be transmitted with the upper attachment. Disadvantageously, the ability to freely expand in the circumferential direction is limited. However, the ability to freely expand in the vertical direction remains entirely unchanged. To prevent stress discontinuities and stress accumulation, the transitions 25, 26 from the upper marginal region of the lug shield 20 to the center and lower region are rounded.

Figure 3A:
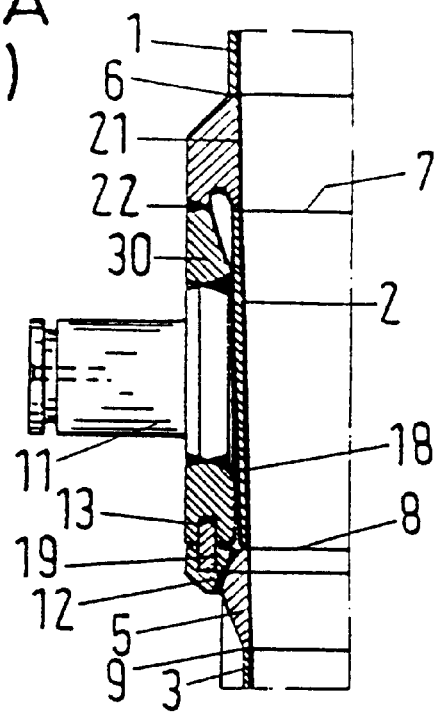
FIGS. 3A–3C depicts a third embodiment, otherwise identical to FIGS. 1A–C.
Figure 3B:
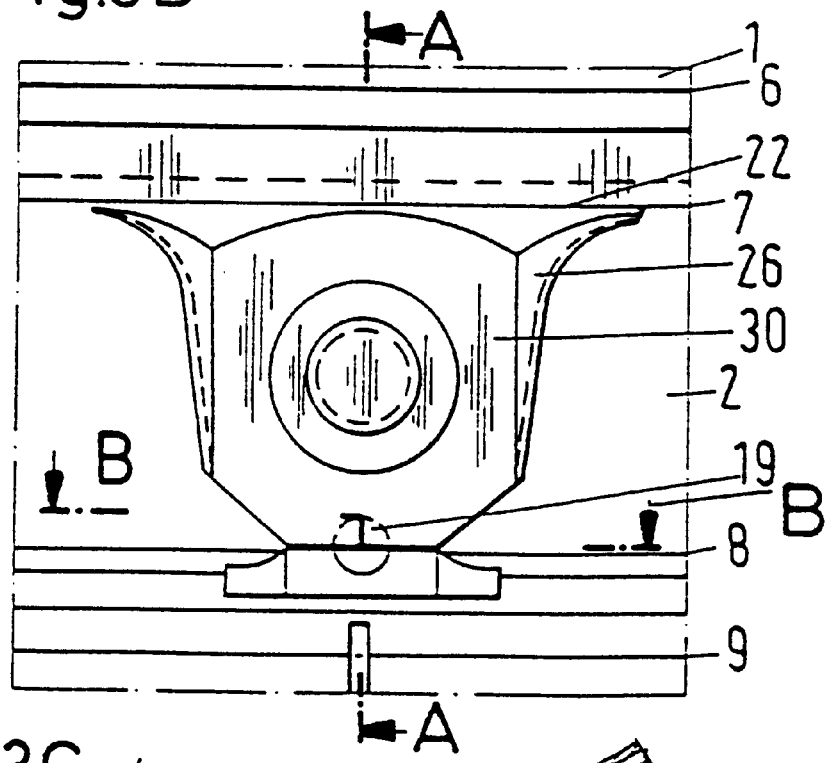
Figure 3C:
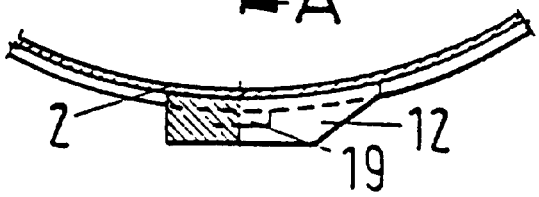
Figure 4A:
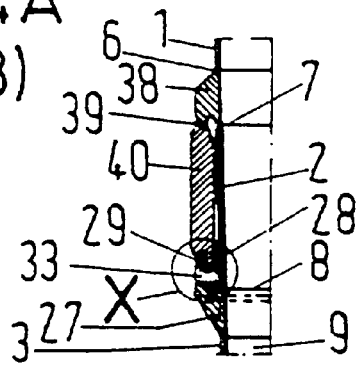
FIG. 4A is a cross-section along the line B—B in FIG. 4B.
Figure 4B:
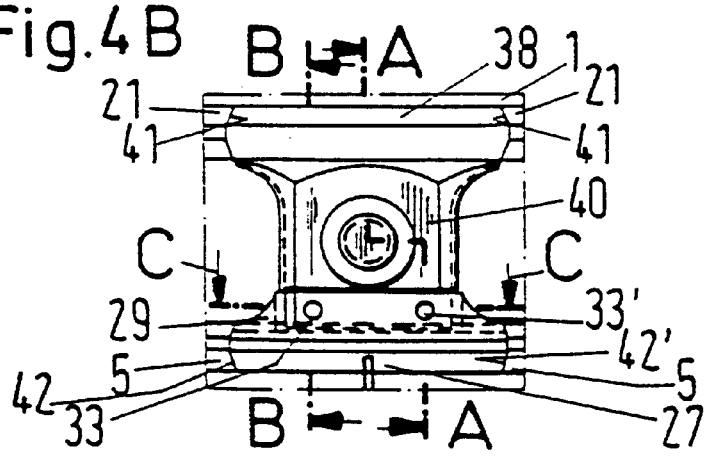
FIG. 4B depicts a fourth embodiment, otherwise identical to FIG. 1B.
Figure 4C:
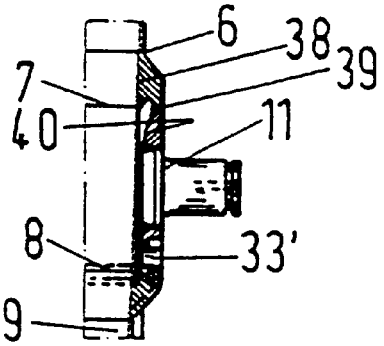
FIG. 4C is a cross-section along the line A—A in FIG. 4B.
Figure 4D:
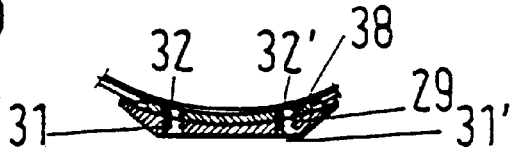
FIG. 4D is a cross-section along the line C—C in FIG. 4B.
Figure 4E:
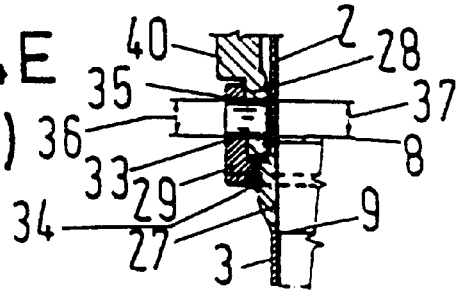
FIG. 4E is an enlarged view of a modification of the detail X.

FIGS. 3A–3C depict a third embodiment, combining elements of the embodiment of FIGS. 1A–1C with elements of the embodiment of FIGS. 2A–2C. The upper marginal region of the lug shield 30 is materially connected with the upper reinforcement ring 21 by a weld seam 22. A guide element 19 in the form of a circular disk engages with a recess 13 disposed in a lower marginal region of the lug shield 30 as well as with a recess of the rib 12 that is attached to the lower reinforcement ring 5. In this way, the lower guide can absorb the own weight of the lug shield 30 as well as the weight of the vessel, when the vessel is in a vertical and tilted position.

As illustrated in FIGS. 4A–4E, the own weight of the lug shield and the vessel can also be absorbed in a different way. In this case, the lower marginal region of the lug shield 40 is formed as a rib 28. The associated lower reinforcement ring 27 has an upwardly extending rib-like extension 29 which is an integral part of the reinforcement ring 27. In this embodiment, the two rib-like regions 28, 29 are in contact with one another, with two mutually aligned openings 31, 31', 32, 32' extending through these regions 28, 29. The openings are preferably formed as bore holes. Holding elements 33, 33', preferably bolts, can be inserted in the openings 31, 31', 32, 32'. To allow an unimpeded movement of the large shield 40 in the vertical direction, the openings 32, 32' disposed in the rib 28 of the lug shield 40 have a larger diameter 37. This can be easily seen in the sectional view 4*e* which shows a modification of the detail X. Unlike the cross-sectional view 4*a*, the rib 29 does not form an integral part of the lower reinforcement ring 27, but is materially connected with the reinforcement ring 27 by a weld seam 34. The inserted lug 33 which is intended to absorb the own weight of the lug shield 40 and/or the vessel, is secured in the opening 31 of the rib 29 by a peripheral seam 35. The opening 32 in the rib-like marginal region 28 of the lug shield 40 has a larger diameter 37 than the diameter 36 of the bolt.

In the embodiments depicted in FIGS. 2A–2C and 3A–3C, the upper marginal region of the respective lug shield 20, 30 is connected to the nose-shaped extension 23 of the peripheral upper reinforcement ring 21 by a seam 22. Conversely, in the embodiment of FIGS. 4A–4E, a separate partial segment 38 is formed which is connected to the upper marginal region of the lug shield 40 by a weld seam 39. The so-formed element is inserted in a corresponding gap between the ends of the peripheral reinforcement ring 21 and connected with one another by the transverse seams 41, 41'. The opposite region is formed in a similar manner. In this embodiment, the guide is also formed as a separate element and includes a partial segment of a reinforcement ring 27 and an upwardly extending rib 29. This separate element is inserted with transverse seams 42, 42' into a corresponding gap between segments of the peripheral lower reinforcement ring 5, and materially connected thereto.

In a similar manner, in the embodiment depicted in FIGS. 5A–5E, the lug shield 50 and the upper region together form a single element. This element is materially connected to the abutting partial segments of a peripheral reinforcement ring 21 by transverse seams 41, 41'. This arrangement has the advantage that instead of the long peripheral weld seam only two relatively short transverse seams are required for attachment. The lug shield 50 is here guided in a different manner. Clamps 43, 43' are disposed on the lower reinforcement ring 5 which encircle the rib-shaped end region 28 of the lug shield 50. Cross-sectional view 5*e* shows how the clamp 43 on the left side is connected to the lower reinforcement ring 5 by weld seams 44, 44'. Both clamps 43, 43' have an angled end region 45, 45' which is separated from the rib 28 by a gap 46, 46'.

Figure 6A:
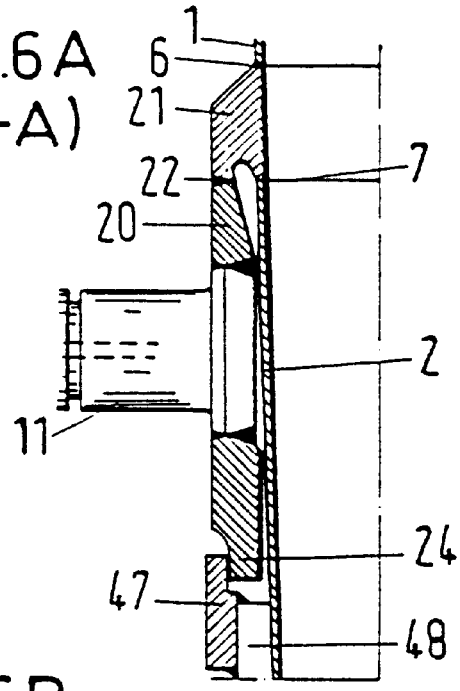
FIG. 6A is a cross-section along the line A—A in FIG. 6B.
Figure 6B:
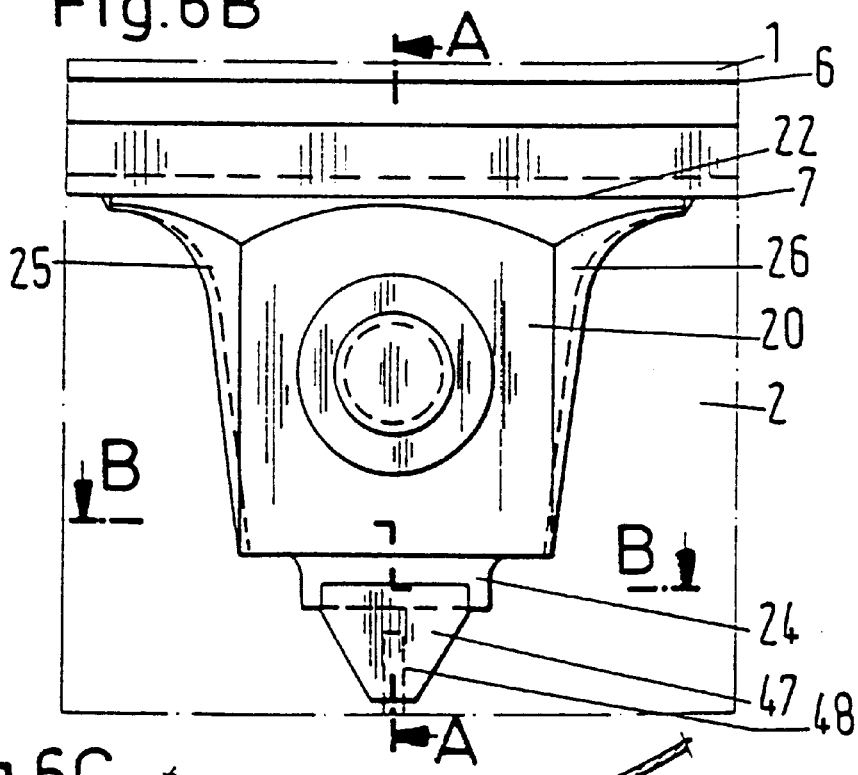
FIG. 6B depicts a sixth embodiment, otherwise identical to FIG. 1B.
Figure 6C:
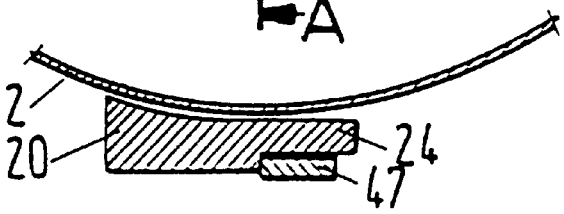
FIG. 6C is a cross-section along the line B—B in FIG. 6B.

FIGS. 6A–C show another embodiment. Unlike the embodiment of FIGS. 2A–C, the section of pipe 2 does not have a lower reinforcement ring 5. A guide metal sheet 47 which guides the lug shield 20, is attached to a vertical brace 48 on the section of pipe 2 at the height of the rib 24. When the vessel thermally expands, the rib 24 of the lug shield 20 slides along the inside of the upper region of the guide metal sheet 47.

Figure 7A:
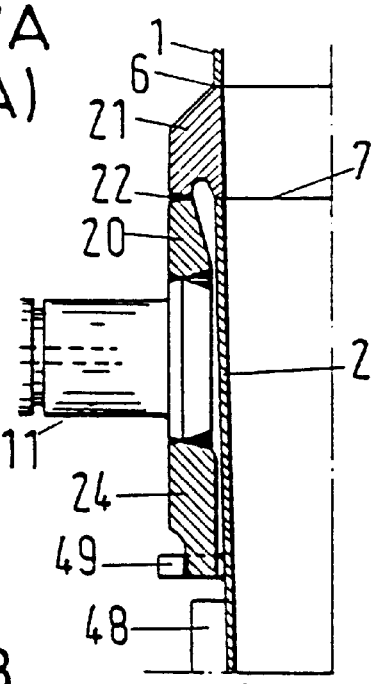
FIGS. 7A–C depicts a modification of the embodiment of FIGS. 6A–C.
Figure 7B:
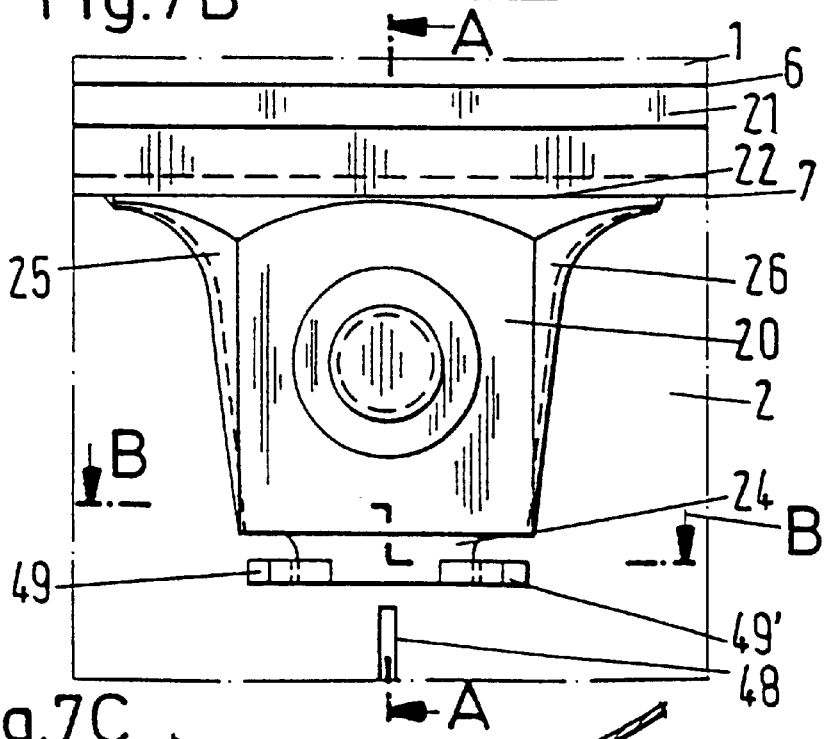
Figure 7C:
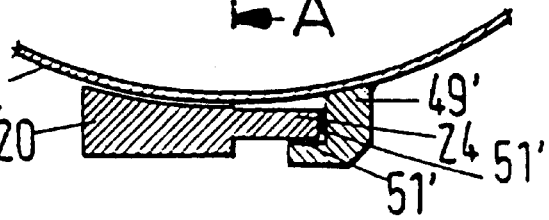

FIGS. 7A–C show a modification of the embodiment of FIGS. 6A–C. In this embodiment, the lower reinforcement ring 5 in the section of pipe 2 has also been omitted. This embodiment does not have a guide metal sheet; instead, the ends of the rib 24 of the lug shield 20 are encircled by two clamps 49, 49' which are attached to the section of pipe 2. To guide the rib 24 of the lug shield 20 along the clamps 49, 49', so-called lining plates 51, 51' are driven on two sides into the gap between the outside of the rib 24 and the inside of the clamps 49, 49'.

Figure 8A:
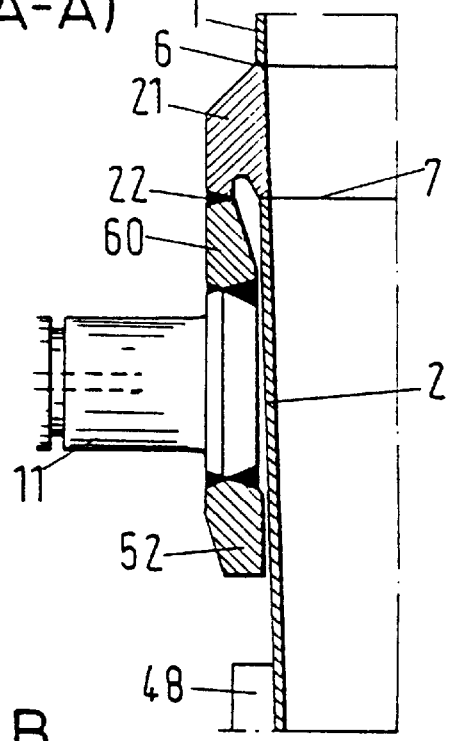
FIG. 8A is a cross-section along the line A—A in FIG. 8B.
Figure 8B:
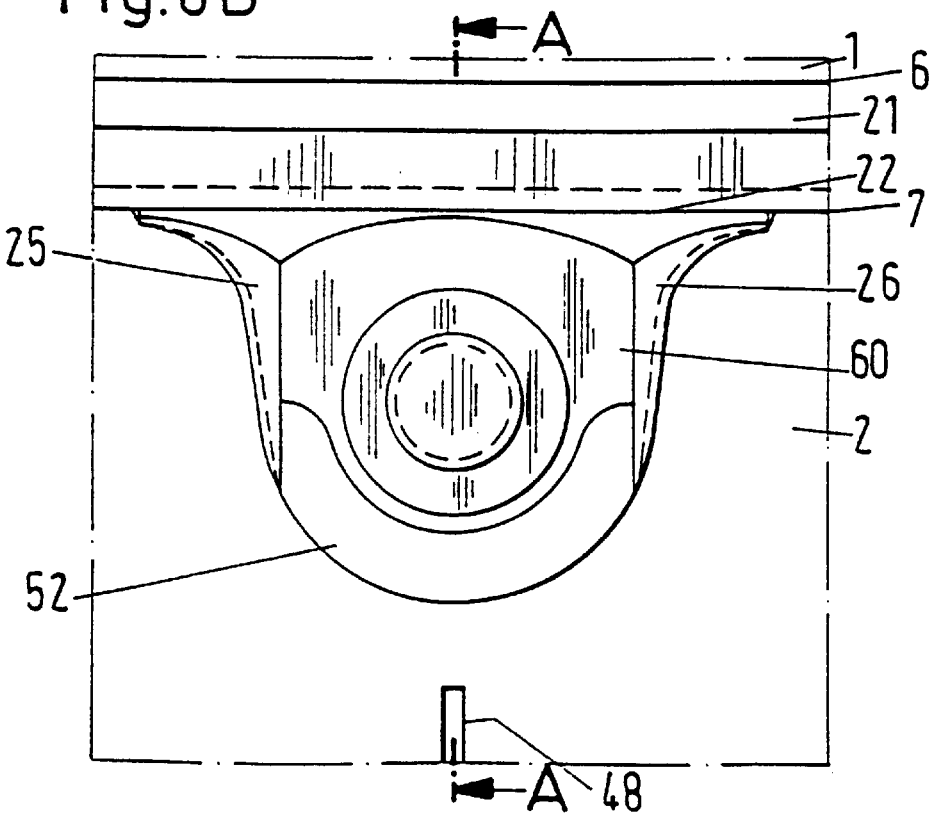
FIG. 8B depicts an eighth embodiment, otherwise identical to FIG. 1B.

FIGS. 8A, 8B show an eighth embodiment, which is similar to the embodiment depicted in FIGS. 6 and 7 in that the section of pipe 2 does not include a lower reinforcement ring 5. Unlike the two embodiments mentioned above, the lug shield 30 in this embodiment does not have a guide. The required stiffness is achieved by providing the lower region 52 of the lug shield 20 with a circular profile, as viewed from the top. In this embodiment, the upper marginal region of the lug shield 60 is connected to the nose-shaped extension of the peripheral upper reinforcement ring 21 by a seam 22. Like the embodiment illustrated in FIGS. 5*a*–5*e*, the upper region of the lug shield 60 together with the associated section of the upper reinforcement ring 21 can be formed as a single element. The so-formed part is materially connected with short transverse seams to the abutting partial segments of the peripheral reinforcement ring 21. This arrangement has the advantage that instead of the long circumferential weld seam 22, only two relatively short transverse seams are required for attachment.

Figure 9A:
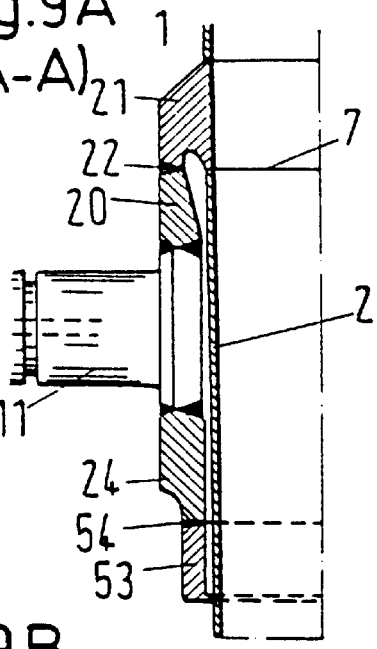
FIG. 9A is a cross-section along the line A—A in FIG. 9B.
Figure 9B:
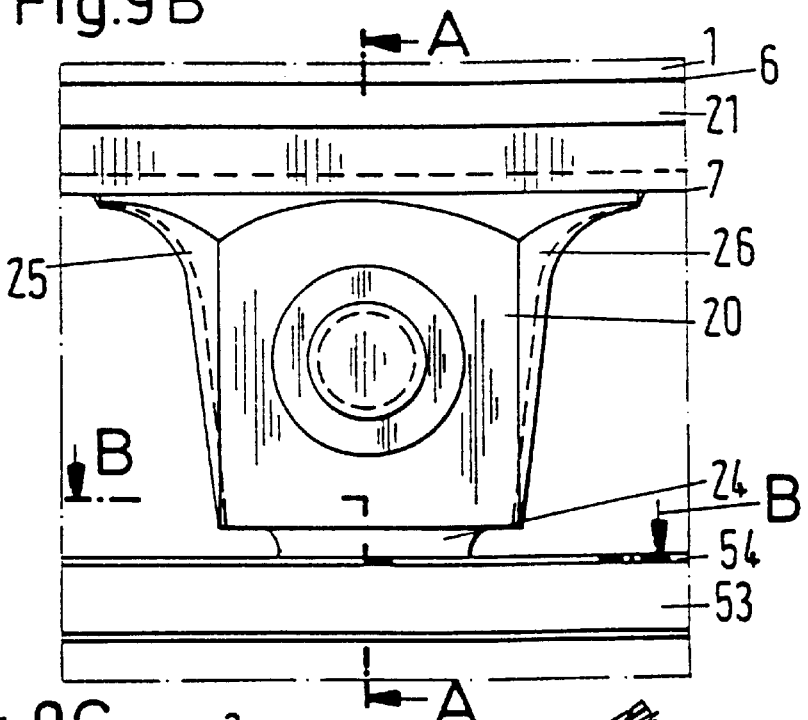
FIG. 9B depicts a ninth embodiment, otherwise identical to FIG. 1B.
Figure 9C:
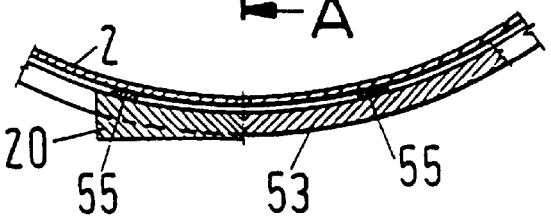
FIG. 9C is a cross-section along the line B—B in FIG. 9B.

Another embodiment is shown in FIGS. 9*a*–*c*. The particular feature of this embodiment lies in the arrangement of a peripheral ring 53 to enhance the stiffness. The ring 53 is attached with a peripheral seam 54 to the rib 24 of the guide shield 20. Spacers 55 are arranged with a predetermined spacing along the circumference and secured on the inside of the shield 20 and/or the ring 53.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed as new and desired to be protected by Letters Patent is set forth in the appended claims:

What is claimed is:

1. Vessel for metallurgical purposes for transporting molten metals, comprising:

a metal jacket having an outside surface and a heat-proof lining, attachment means disposed in opposing relationship on the outside surface of the metal jacket, two lug shields supported by the attachment means so as to allow limited movement between the lug shields and the metal jacket in an axial and peripheral direction of the metal jacket, and two lifting lugs, each lifting lug rigidly connected to a respective one of the lug shields, wherein the attachment means supports a weight of the lug shields and of the vessel, when the vessel is in a vertical or tilted position.

2. Vessel for metallurgical purposes for transporting molten metals, comprising:

a metal jacket comprised of individual sections of pipe and having a heat-proof lining, the metal jacket having an outer surface and further including two axially spaced-apart reinforcement rings integrated with the metal jacket, attachment means disposed in opposing relationship on at least one of the outside surface of the metal jacket and the reinforcement rings, two lug shields radially spaced-apart from the metal jacket and supported by the attachment means so as to allow limited movement between the lug shields and the metal jacket in an axial and peripheral direction of the metal jacket, and two lifting lugs, each lifting lug rigidly connected to a respective one of the lug shields, wherein the attachment means supports a weight of the lug shields and of the vessel, when the vessel is in a vertical or tilted position.

3. The vessel of claim 2, wherein the attachment means are in the form of a box which encircles a respective one of the lug shields, with the lug shields adapted for limited movement within the box.

4. The vessel of claim 2, wherein each lug shield comprises a projection and the attachment means are in the form of clamps which encircle marginal regions of the projection.

5. The vessel of claim 2, wherein each lug shield has a plurality of marginal regions, and only a first marginal region that faces a first of the two reinforcement rings is materially connected with the first reinforcement ring.

6. The vessel of claim 5, wherein a second marginal region opposite the first marginal region is capable of moving freely and guided in a vertical direction by guide means disposed on the second reinforcement ring.

7. The vessel of claim 6, wherein the guide means form an integral part of the second reinforcement ring.

8. The vessel of claim 6, wherein the guide means are formed separate from the second reinforcement ring and connected to the second reinforcement ring by a weld seam.

9. The vessel of claim 6, wherein the second reinforcement ring is the lower of the two axially spaced reinforcement rings.

10. The vessel of claim 6, wherein the second reinforcement ring has an upwardly pointing, nose-shaped projection which formfittingly engages in a recess disposed on an underside of the first marginal region.

11. The vessel of claim 6, the second reinforcement ring further comprising a bow-shaped peripheral guiding tang attached to the second reinforcement ring in a region of a corresponding lug shield, said guiding tang having a gap that is open in an upward and downward direction, wherein the first marginal region is formed as a projection that engages with the gap of the guiding tang.

12. The vessel of claim 4, wherein at least one clamp is attached to the second reinforcement ring in a region of a corresponding lug shield and engages with a marginal region of the projection.

13. The vessel of claim 12, wherein the at least one clamp, as viewed in cross-section, has a slot-like recess that faces the marginal region of the projection.

14. The vessel of claim 12, wherein the at least one clamp, as viewed in cross-section, is formed as an angular member which makes sliding contact with a marginal region of a corresponding lug shield only along an outer surface region.

15. The vessel of claim 6, wherein the reinforcement ring has an upwardly pointing, nose-shaped projection in the region of a corresponding lug shield, wherein an outside region of the first marginal region is also formed as a projection, which slidingly contacts an inner surface region of the projection of the reinforcement ring.

16. The vessel of claim 15, wherein the projection of the reinforcement ring and the projection of the first marginal region each have at least one mutually aligned opening, through which opening a holding element can be inserted with play.

17. The vessel of claim 16, wherein the holding element is secured in the opening of the projection of the reinforcement ring with a weld seam.

18. The vessel of claim 5, wherein the first marginal region forms a segment of the reinforcement ring and wherein abutting segments are connected by transverse seams.

19. The vessel of claim 18, wherein the first marginal region is an integral segment of the reinforcement ring.

20. Vessel for metallurgical purposes for transporting molten metals, comprising:

a metal jacket comprised of individual sections of pipe and having a heat-proof lining, the metal jacket having an outer surface and further including a reinforcement ring integrated with the metal jacket, attachment means disposed in opposing relationship on at least one of the outside surface of the metal jacket and the reinforcement ring, two lug shields radially spaced-apart from the metal jacket and supported by the attachment means, said lug shield materially connected with the reinforcement ring, two lifting lugs, with each lifting lug supported by a respective one of the lug shields, and means that prevents a radial excursion of the lug shields relative to the metal jacket while allowing limited movement between the lug shields and the metal jacket in an axial and peripheral direction of the metal jacket, wherein the attachment means supports a weight of the lug shields and of the vessel, when the vessel is in a vertical or tilted position, and wherein a projection of a respective lug shield is in contact with the means that prevents the radial excursion.

21. The vessel of claim 20, further including a vertical brace disposed on a section of pipe, with the means that prevents the radial excursion being a guide metal sheet that is attached to the vertical brace, wherein a free inside face of the guide metal sheet slidingly contacts a free outside face of the projection of the lug shield.

22. The vessel of claim 20, wherein the means that prevents the radial excursion is an angled clamp which is secured on the metal jacket and encircles an end region of the projection of the lug shield.

23. The vessel of claim 20, wherein the means that prevents the radial excursion is a ring which encircles the metal jacket and is materially connected with the projection of the lug shields.

24. The vessel of claim 23, further comprising spacers which bridge a gap between the metal jacket and the ring and are secured along a circumference of at least one of the lug shields and the ring.

25. The vessel of claim 20, wherein in a top view a lower marginal region of the lug shields has the form of a circular arc.

26. The vessel according to claim 1, wherein the attachment means are in the form of a box which encircles a lug shield, with the lug shield adapted for limited movement within the box.

27. The vessel of claim 1, wherein the lug shield comprises a projection and the attachment means are in the form of clamps which encircle marginal regions of the projection.

* * * * *

UNITED STATES PATENT AND TRADEMARK OFFICE

CERTIFICATE OF CORRECTION

PATENT NO. : 6,613,272 B2
DATED : September 2, 2003
INVENTOR(S) : Franz-Josef Divjak et al.

It is certified that error appears in the above-identified patent and that said Letters Patent is hereby corrected as shown below:

Title page,
Item [73], Assignee, replace “Münlheim” with -- Mülheim --

Signed and Sealed this

Twenty-first Day of December, 2004

JON W. DUDAS
*Director of the United States Patent and Trademark Office*